US007700502B2

(12) United States Patent
Butz et al.

(10) Patent No.: US 7,700,502 B2
(45) Date of Patent: Apr. 20, 2010

(54) ANTIMICROBIAL TEXTILE

(75) Inventors: Volker Butz, Neustadt (DE); Thomas Schiwek, Schifferstadt (DE)

(73) Assignee: THOR GmbH, Speyer (DE)

( * ) Notice: Subject to any disclaimer, the term of this patent is extended or adjusted under 35 U.S.C. 154(b) by 0 days.

(21) Appl. No.: 12/308,551

(22) PCT Filed: Jun. 28, 2007

(86) PCT No.: PCT/EP2007/056492

§ 371 (c)(1),
(2), (4) Date: Jun. 17, 2009

(87) PCT Pub. No.: WO2008/000796

PCT Pub. Date: Jan. 3, 2008

(65) Prior Publication Data

US 2009/0318044 A1 Dec. 24, 2009

(30) Foreign Application Priority Data

Jun. 30, 2006 (EP) ..... 06116455

(51) Int. Cl.
*B32B 27/12* (2006.01)

(52) U.S. Cl. ..... 442/123

(58) Field of Classification Search ..... 442/123, 442/124; 428/402, 403, 407
See application file for complete search history.

(56) References Cited

U.S. PATENT DOCUMENTS

| | | | |
|---|---|---|---|
| 6,361,788 | B1 | 3/2002 | Antoni-Zimmermann et al. |
| 2004/0234603 | A1 | 11/2004 | Baum et al. |
| 2005/0150056 | A1 | 7/2005 | Copete Vidal et al. |

FOREIGN PATENT DOCUMENTS

| | | | |
|---|---|---|---|
| EP | 0 266 909 | A1 | 6/1988 |
| EP | 0 457 435 | A2 | 11/1991 |
| EP | 0 457 435 | A3 | 11/1991 |
| WO | WO98/18998 | A1 | 5/1998 |
| WO | WO99/08530 | A1 | 2/1999 |
| WO | WO01/97610 | A1 | 12/2001 |
| WO | WO02/17716 | A1 | 3/2002 |
| WO | WO03/093571 | A1 | 11/2003 |
| WO | WO2004/000953 | A1 | 12/2003 |

OTHER PUBLICATIONS

PCT Search Report dated Dec. 20, 2007.

Rompp, Chemie Lexikon, Thieme Verlag Stuttgart, 9., erweiterte Auflage, 1995, Band A-C1, Seite 159.

C.A. Finch, R. Bodmeier, Microencapsulation, Ullmann's Encyclopedia of Industrial Chemistry, 6. Auflage 2001, vol. 21, Electronic Release, Seite 733 bis 749.

Database WPI Week 200608 Derwent Publications Ltd. London, GB; XP-002407002 AN2006-072484 A (Tokyo Fine Chem KK), Jan. 5, 2006, Zusammenfassung.

*Primary Examiner*—Arti Singh-Pandey
(74) *Attorney, Agent, or Firm*—Hedman & Costigan, P.C.; James V. Costigan

(57) ABSTRACT

A textile finished with a biocidally active component is provided. The textile is characterized in that the biocidally active component is contained in the textile and comprises 2-n-octyl-4-isothiazolin-3-one and also, optionally, one or more other biocides and the biocidally active component is enclosed in microparticles composed of an aminoplast resin. The enclosure of the biocidally active component in the microparticles causes the biocidally active component to stay on the textile during the drying and curing involved in the finishing process. In addition, in practical use, the biocidally active component is only released slowly and is not washed off by exposure of the textile to rain or water. This stops a large part of the biocidally active component escaping during the finishing of the textile or being washed off the tenting, awnings, filters, tarpaulins, shower curtains and the like after just a few (rain) showers.

10 Claims, No Drawings

ANTIMICROBIAL TEXTILE

This invention relates to a textile finished with at least one biocidally active component to be antimicrobial. The biocidally active component is enclosed in a resin based on an aminoplast. The enclosed biocidally active component is useful as textile auxiliary for finishing textiles, for example tenting, awnings, tarpaulins, shower curtains, nonwovens, filters, carpets and the like.

Most textiles contain microbiologically degradable material. They are either wholly or partly made of microbiologically degradable fibers, for example of cotton, hemp, flax, linen, viscose, Tencel, acetate, silk, wool. Textiles made of synthetic fibers such as for example polyester, polyacrylonitrile, polyamide, polypropylene, Nomex, aramid become susceptible to microbiological attack when they are provided with finishing agents, for example sizes, spooling oils, spinning oils, softeners, plasticizers, hydrophobicizers, antistats, and/or binders, or pick up microbiologically degradable material in use, examples being organic substances from the environment or soap residues. Colonization by fungi, algae or bacteria can have a negative impact on the performance characteristics of textiles as well as their appearance. In addition, the release of metabolism products can cause unpleasant odor nuisances or pose a health hazard.

It is therefore necessary to finish textiles with preservatives, in particular with biocides such as bactericides, fungicides and/or algicides in order that colonization by microorganisms, for example by fungi, such as molds, and also by bacteria, cyanobacteria, yeasts and algae may be controlled.

However, difficulties arise when trying to finish a textile with biocides, these difficulties concerning not only the finishing operation as such but also phenomena due to the finish.

The textile industry expects the biocides used for finishing textiles to meet high requirements. For example, textiles typically have to be dried at temperatures of 100 to 130° C. after finishing in order that sufficient hydrophobicity may be obtained in addition, and subsequently treated at temperatures of up to 180° C. The high evaporation rate of the biocides at these temperatures frequently leads to high losses of active component. Losses of active component of more than 95% after finishing are observed particularly on the surface of synthetic fibers, for example polyester, polyamide, polypropylene or polyacrylonitrile fibers.

The active component remaining on the textile after finishing is washed off in practical use of the textile when it is "watered", as in a rain shower for example, owing to the large surface area of the textile and the low thickness of the layer of finish. This washoff results in a further considerable loss of active component. Furthermore, the influence of light can lead to decomposition of the biocidally active components remaining after finishing.

After finishing has taken place, the interaction of certain heavy metal ions, for example iron, with certain biocides, for example zinc pyrithione, causes observable discolorations of the textiles.

There are effective biocides which have a low rate of evaporation and/or substantially stay on a textile in watering. Generally, however, biocides which are satisfactory in this regard are less suitable for the finishing of textiles because of toxic effects. Chlorothanonil is one example and particularly the suspected carcinogen carbendazime is another. Skin irritations are another disadvantageous effect. When the textiles which have been finished to be antimicrobial are made up (for example cut, sewn, etc.), skin contact occurs even in the case of textiles which generally do not come into contact with the human body during the intended use.

Owing to the above-described volatilization of the active components, it is frequently necessary to use high concentrations of sometimes costly active components having high minimum inhibitory concentration (MIC) values in order that, despite the losses of active component in drying, showering or watering, the desired antimicrobial effect, sufficient to meet practical requirements, may be met, which entails appreciable costs. Furthermore, the high use concentrations and the high losses of biocidally active component impact the environment during production and use of these products.

Finally, there is the adverse effect of many biocides on the water-repelling effect of the impregnation or coating. This results in faster wetting with water, which in turn leads to accelerated release of the active components. In general, active concentration drops below the minimum inhibitory concentration (MIC) of the biocides after just a few rain exposure cycles. There is therefore no longer any long-term effect.

It is an object of the present invention to provide an antimicrobial textile which substantially avoids the above-recited disadvantages and, in particular, minimizes the escape of the biocidally active component during finishing. This shall reduce the environmental impact and the costs of finishing the textile to control harmful microorganisms and reduce the rate of evaporation of the biocidally active component out of the finished textile. The antimicrobial effect of the microbicide used for finishing shall be ensured for a very long period.

We have found that this object is achieved by providing a textile finished with a biocidally active component, wherein the biocidally active component is contained in the textile and comprises 2-n-octyl-4-isothiazolin-3-one (OIT) and also, optionally, one or more other biocides, the biocidally active component being enclosed in microparticles composed of an aminoplast resin, preferably a melamine-formaldehyde resin.

The term "biocidally active component" herein refers to the substance or substance mixture which has the biocidal effect underlying the present invention. The biocidally active component at all times comprises OIT with or without further active component as more particularly defined hereinbelow.

In one embodiment of the present invention, the biocidally active component contained in the microparticles comprises OIT and also, additionally, one or more other biocides. The ratio of OIT to the other biocide or biocides can in principle fluctuate and be varied within wide limits, for example in the range from 100:1 to 1:100, preferably 50:1 to 1:50. In this embodiment of the present invention, the OIT is typically present in amounts of 10% to 95% by weight, in particular of 20% to 80% by weight, and the other biocide or biocides is or are present in amounts of 5% to 90% by weight, in particular of 20% to 80% by weight, all based on the total amount of biocidally active component contained in the microparticle.

In another embodiment, the biocidally active component enclosed in the microparticles consists predominantly of OIT. In other words, the enclosed biocidally active component contains mainly OIT, preferably in an amount of not less than 50% by weight of OIT, more preferably in an amount of not less than 70% by weight, particularly in an amount of not less than 90% by weight, particularly in an amount of not less than 95% by weight of OIT, based on the overall mass of biocidally active component. At least one further biocide can be present as well.

In another embodiment of the present invention, the biocidally active component enclosed in the microparticles consists essentially of OIT; that is, as well as OIT there may also be one or more other biocides, but these are present in such an amount that the biocide other than OIT makes no contribution to the total effect due to the resulting mixture. Thus, when the biocidal effect of a biocidally active component (biocidal mixture) which as well as OIT as essential constituent additionally includes one or more further biocides in a minor concentration is no different to that of using OIT alone as single biocide, this is herein referred to as "consisting essentially".

In another embodiment, the biocidally active component can consist of OIT as sole biocidally active component, i.e., an active component content of 100% OIT. In such a case it is merely possible for one or more further constituents without a biocidal effect to be present.

The term textile herein relates to fibers for textile use, textile intermediate and end product, such as filaments, yarns, threads, wovens, knits, nonwovens and the like and also textile finished articles such as clothing for example. The term textile is preferably to be understood as meaning textile units or subunits of textiles, for example tenting, awnings, parasols, umbrellas, tarpaulins, shower curtains, nonwovens, filters, carpets and the like.

The term aminoplast resins herein is understood as meaning polycondensation products formed from carbonyl compounds, in particular from formaldehyde, and NH-containing compounds, for example urea (urea resins), melamine (melamine resins), urethanes (urethane resins), cyano and dicyanamide (cyano resins and dicyanamide resins respectively), aromatic amines (aniline resins) and sulfonamides (sulfonamide resins), see Römpp, Chemie Lexikon, Thieme Verlag Stuttgart, 9th expanded edition, 1995, volume A-C1, page 159. The cited section of the literature reference is incorporated herein by reference. Preferred materials for the microparticles are melamine, urea and dicyandiamide formaldehyde resins, particularly preferred materials being melamine formaldehyde resins.

The aforementioned urea resins are curable condensation products formed from ureas and aldehydes and belonging to the aminoplasts; they comprise formaldehyde in particular. They are prepared by reacting urea or substituted ureas with formaldehyde in molar excess under mostly alkaline conditions. The products are hydroxymethyl-containing oligomers, which are cured by crosslinking. Instead of formaldehyde, other aldehydes can also be used, examples being acetaldehyde and glyoxal. Similarly, condensates based on modified ureas are herein useful starting materials for preparing the microparticle material.

Melamine resins are aminoplast resins wherein melamine has been polycondensed, under suitable conditions, with carbonyl compounds such as aldehydes and ketones, for example formaldehyde, acetaldehyde or glyoxal. They are generally prepared by reacting melamine with the carbonyl compound in molar excess. Particular interest in this context pertains to the polycondensation products of melamine with formaldehyde (melamine formaldehyde resins) or else urea- or phenol-modified melamine formaldehyde resins (respectively melamine urea formaldehyde resins and melamine phenol formaldehyde resins).

The microparticles which contain the biocidally active component in an enclosed state can also be formed from two or more of the aforementioned aminoplast resins. The microparticle material has to be chosen with care particularly to avoid destroying or inhibiting the biocidally active component in the course of synthesis.

Enclosure of the biocidally active component in the microparticles surprisingly ensures that the biocidally active component is only minimally volatilized or released, if at all, in the course of the production of the textile during the drying and curing despite the high temperatures employed here, yet remains biocidally active at the same time; and the biocidally active component stays on the textile, so that it can be used in correspondingly low concentrations. In practical use, the biocidally active component is slow-released only. It has advantageously emerged in this connection that the biocidally active component enclosed in the microparticles is not, as would usually be expected, washed off to a high degree during showering or watering of the textiles finished with it. According to the present invention, therefore, lower amounts of active component can be used for finishing and, on the other hand, appreciably longer active periods achieved.

In accordance with the present invention, the term microparticle applies to any kind of particles comprising a wall structure and at least one void formed by the wall structure. The wall structure contains one or more aminoplast resins, preferably one aminoplast resin. The voids formed by the wall structure can be closed or else open, and contain the biocidally active component with and without further different auxiliary materials. Closed voids can be present for example in the form of capsule structures or cell structures, while open voids can be present in the form of pores, passageways and the like. For the purposes of the present invention, the term microparticle likewise comprehends a matrix composed of an aminoplast resin, the biocidally active component being enclosed in or enveloped by the matrix. The term microparticle can also apply to so-called microcapsules, in the interior of which the biocidally active component is enclosed by being encapsulated.

The microparticles preferably have a spherical shape. This shape has the advantage of combining a high volume with a small surface area, so that impinging water has a small wetting area. As a result, rain exposure of the textiles finished with the microparticles merely releases a small portion of the biocidally active component. This prevents the washoff of a large proportion of the biocidally active component from the textiles, such as tenting, awnings, tarpaulins, shower curtains and the like, after just a few (rain) showers. The long-term effect of the antimicrobial finish on the textiles is appreciably improved. The result is durable protection of the textiles against microbial attack.

The median diameter of the microparticles useful for finishing textiles is typically in the range from about 0.5 to about 100 μm and preferably in the range from about 1 to about 10 μm. The size of the microparticles can be determined for example under the microscope using a micrometer scale.

The textiles are finished such that the antimicrobially finished textile generally comprises an amount of biocidally active component of 0.0001% by weight to 0.5% by weight, preferably 0.01% by weight to 0.2% by weight and more preferably 0.05% by weight to 0.15% by weight, based on the overall weight of the textile.

Since at all times only a small concentration of the biocidally active component is present on the surface of the microparticles and hence on the surface of the textiles, the product characteristics of the textile, for example its hydrophobicity or oleophobicity, are not adversely affected.

Furthermore, the slow release of the biocidally active component makes it possible to achieve a long-term effect at comparatively low use concentrations. This affords not only ecological but also economic advantages, since only a small proportion of the biocidally active component is lost during the processing of the textiles and, therefore, significantly smaller amounts of it can be used.

The enclosure of the biocidally active component in the microparticles results not just in the advantage of a slow release for the biocidally active component but also in the biocidally active component being screened or shielded by the particle wall, resulting in increased stability for the biocidally active component to UV radiation, elevated temperatures, heavy metal ions and pH values. For instance, the active period of the biocidally active component is appreciably lengthened by virtue of a lower rate of decomposition.

Biocides are used in many sectors and for controlling bacteria, fungi or algae. It has long been known to use compounds from the class of the 3-isothiazolin-3-ones (also known as 3-isothiazolones) in particular in such compositions. This class of compounds includes very efficacious biocides, not all having the same performance profile. Combinations of various 3-isothiazolin-3-ones or else of one or more 3-isothiazolin-3-ones with other known biocidally active components are often used (see inter alia WO 99/08530 A, EP 0457435 A, EP 0542721 A and WO 02/17716 A). In light of the ever growing requirements for such biocidal compositions, for example with regard to health and environmental aspects, the antimicrobial finishing of textiles requires further development of existing products.

Biocidally active components enclosed in a melamine formaldehyde resin and adapted for use in coating compositions, in particular in facade renders, are known from commonly assigned WO 2004/000953. However, there is no indication in this application that OIT enclosed in an aminoplast resin, preferably in a melamine formaldehyde resin, is very useful for finishing textiles. What is surprising in particular is the fact that the high temperatures needed in the finishing step cause only minimal escapage of the biocidally active component from the microparticles, but that the particles, after finishing, slow-release the biocidally active component to the desired degree.

Enclosure of the biocidally active component in microparticles based on an aminoplast resin substantially prevents release of the biocidally active component during the drying or thermal aftertreatment involved during the textile finishing process. The antimicrobially finished textile is characterized in that less than about 70%, preferably less than about 50% and more preferably less than 10% of the biocidally active component escapes during drying or thermal aftertreatment. This reduces not just the loss of biocidally active component, but also emission into the air/environment. The biocidal activity of the biocidally active component is retained despite the enclosure of the biocidally active component in microparticles.

Good results are achieved according to the present invention when the microparticles of the present invention comprise 5% to 99.99% by weight of the aminoplast resin and 0.01% to 95% by weight of the biocidally active component, preferably 15% to 60% of the aminoplast resin and 85% to 40% by weight of the biocidally active component, based on the overall weight of aminoplast resin and biocidally active component.

The known 2-n-octyl-4-isothiazolin-3-one (OIT) has antimicrobial properties which are inherently desirable for the finishing of textiles. There are specifically a fungicidal effect and an algicidal effect, which combine to make for an active component profile which is advantageous for textile use. 1,2-Benzoisothiazolin-3-one (BIT), which has particularly good bactericidal properties, is very soluble in water and very volatile at comparatively high temperatures and therefore likewise only conditionally suitable for textile uses.

The use of the microparticles of the present invention is by virtue of the broad performance spectrum of OIT particularly useful for finishing textiles used in the outdoor sector, since OIT comprises a biocide with fungicidal and algicidal performance. It contains neither halogen nor heavy metal compounds, is not persistent or accumulable, is not classified as a CMR material, and does have a favorable human toxicity and ecotoxicity profile. In general, therefore, it is very well suited in terms of its properties to be used for the finishing of textiles. Its use is therefore advantageous not only ecologically and commercially but also because of its advantageous performance spectrum.

As well as OIT, the microparticles may additionally enclose one or more other biocides, which can be selected according to the field of use. Specific examples of such additional biocides follow:

benzyl alcohol; 2,4-dichlorobenzyl alcohol; 2-phenoxyethanol; 2-phenoxyethanol hemiformal, phenylethyl alcohol; 5-bromo-5-nitro-1,3-dioxane; bronopol; formaldehyde and formaldehyde source materials; dimethyloldimethylhydantoin; glyoxal; glutaraldehyde; sorbic acid; benzoic acid; salicylic acid; p-hydroxybenzoic esters; chloroacetamide; N-methylolchloracetamide; phenols, such as p-chloro-m-kresol and o-phenylphenol; N-methylolurea; N,N'-dimethylolurea; benzyl formal; 4,4-dimethyl-1,3-oxazolidine; 1,3,5-hexahydrotriazine derivatives; quaternary ammonium compounds, such as N-alkyl-N,N-dimethylbenzylammonium chloride and di-n-decyldimethylammonium chloride; cetylpyridinium chloride; diguanidine; polybiguanide; chlorhexidine; 1,2-dibromo-2,4-dicyanobutane; 3,5-dichloro-4-hydroxybenzaldehyde; ethylene glycol hemiformal; tetra(hydroxymethyl)phosphonium salts; dichlorophene; 2,2-dibromo-3-nitrilopropionamide; 3-iodo-2-propynyl N-butylcarbamate; methyl N-benzimidazol-2-ylcarbamate; 2,2'-dithiodibenzoic acid di-N-methylamide; 2-thiocyanomethylthiobenzo-thiazole; C-formals such as 2-hydroxymethyl-2-nitro-1,3-propanediol and 2-bromo-2-nitropropane-1,3-diol; methylene bisthiocyanate; reaction products of allantoin; 2-methylisothiazolin-3-one; N-alkyl-1,2-benzisothiazolin-3-ones having 1 to 8 carbon atoms in the alkyl radical; N-methyl-1,2-benzisothiazolin-3-one; N-butyl-1,2-benzisothiazolin-3-one; 4,5-dichloro-2-n-octylisothiazolin-3-one; 4,5-trimethylene-2-methylisothiazolin-3-one; 1,2-benzisothiazolin-3-one (BIT); zinc pyrithione; chlorothalonine; propioconazole; tebuconazole; TCMTB; IPBC, terbutryn, cyfluthrin, isoproturon triclosan.

Examples of formaldehyde source material are N-formals, such as tetramethylolacetylene-diurea; N,N'-dimethylolurea; N-methylolurea; dimethyloldimethylhydantoin; N-methylolchloracetamide; reaction products of allantoin; glycol formals, such as ethylene glycol formal; butyl diglycol formal; benzyl formal.

In accordance with the present invention, preferred biocidally active components are OIT alone or OIT combined with one or more biocides selected from the group consisting of BIT, N-butyl-BIT, N-methyl-BIT, IPBC, tebuconazole, DCOIT, terbutryn, cyfluthrin, isoproturon triclosan and zinc pyrithione.

In one embodiment, the use of OIT as sole biocidally active component is preferred.

In another embodiment of the invention, a combination of the biocidally active components OIT and BIT is preferred.

When, as well as OIT, further biocides are used as biocidally active component in the microparticles of the present invention, this further biocide may be present in the microparticles as a mixture with the OIT. But it is also possible to mix microparticles containing OIT only with microparticles containing the further biocide only and to apply this mixture of microparticles to the textile.

The microparticles containing the biocidally active component may in addition to the biocidally active component contain other customary admixture materials customary for textile application and known to a person skilled in the art.

These are for example thickeners, defoamers, pH regulators, scents, dispersants and coloring or discoloration-avoiding materials, complexing agents and stabilizers such as UV stabilizers for example.

In accordance with the present invention, the microparticles used for finishing textiles preferably comprise no solvents not generally recognized as safe. Water is the solvent preferably used in the production process.

In one particular embodiment of the present invention, when further solvents are used in the preparation of the microparticles, these further solvents can be polar or apolar or mixtures containing polar and apolar solvents.

As well as water suitable further polar liquid solvents are aliphatic alcohols having 1 to 4 carbon atoms, for example ethanol and isopropanol, a glycol, for example ethylene glycol, diethylene glycol, 1,2-propylene glycol, dipropylene glycol and tripropylene glycol, a glycol ether, for example butyl glycol and butyl diglycol, a glycol ester, for example butyl diglycol acetate or 2,2,4-trimethylpentanediol monoisobutyrate, a polyethylene glycol, a polypropylene glycol, N,N-dimethylformamide or a mixture of 2 or more thereof. The polar liquid solvent is water in particular.

Useful apolar liquid solvents include for example aromatics, preferably xylene and toluene. These too can be used alone or as a mixture of 2 or more of such solvents.

In one preferred embodiment of the present invention, the microparticles are anchored to the textiles with the aid of a dressing (for example polymer dispersions, amino resins, melamine formaldehyde resins, paraffin emulsions, fluorocarbon emulsions, silicone emulsions). A dressing is an impregnating liquid which is applied to textile threads or textiles in general by spraying, dipping or coating. The finishing of the textiles with the microparticles can thus be done in one operation with the application of the dressing. The attachment of reactive groups onto the surface or a reactive anchoring of the microparticles with the textile fibers is not necessary.

The microparticles can further be physically bonded to the fibers of the textiles with the aid of a polymer. The polymer overcoating typically comprises an overcoating composed of polymers as for example polyacrylates, polyvinyl acetate, polyesters, polyvinyl alcohols, polyurethanes and also mixtures thereof. The polymer is preferably used in application as a dispersion.

In another embodiment of the present invention, the microparticles of the present invention are chemically anchored to the surface of the textiles. Since the surface of the microparticles includes reactive groups, such as amino groups, hydroxyl groups and methylol groups ($CH_2$—OH), it is possible to anchor these with the aid of a suitable reactive binder, for example an isocyanate, in particular a protected or blocked isocyanate, permanently to the textile surface. By suitably choosing the monomer ratio in the preparation of the aminoplast resin, for example the ratio of formaldehyde to melamine in the melamine formaldehyde resins, it is possible to influence the identity and number of reactive groups. For example, an excess of melamine results in an increased presence of amino groups.

The chemical anchoring of the microparticles of the present invention makes it possible to achieve good laundering durability for the textiles.

The present invention further provides for the use of aminoplast resin based microparticles containing the active component 2-n-octyl-4-isothiazolin-3-one and optionally one or more other biocides for protecting textiles against attack by microorganisms.

In another embodiment of the present invention, the term textile may herein also comprise a filter or nonwoven, preferably an air filter which is finished with the microparticles in which the biocidally active component is enclosed. The filter material is finished with the microparticles of the present invention in order that the growth of fungi, algae and bacteria in the filter may be at least substantially prevented. Filters thus finished are useful in air conditioning systems and also in exit air and feed air systems. More particularly, filters thus finished are useful in ventilation systems or air conditioning systems in abattoirs, since the finishing of the filter material with the microparticles of the present invention makes it possible to wash off the filter without it losing its antimicrobial activity in the process. It has been determined as particularly effective with this embodiment of the present invention for the biocidally active component to comprise a mixture of OIT and BIT. The advantage of this biocidally active component resides in the fact that OIT is effective in preventing the filter being attacked by algae and fungi and BIT is effective in preventing the filter being attacked by bacteria.

The microparticles of the present invention preferably enclose the biocidally active component in finely disperse, liquid or solid phase; it is particularly preferable for the biocidally active component to be incorporated in an aqueous medium in the course of the production of the microparticles.

Numerous processes are known for producing these microparticles, see for example C. A. Finch, R. Bodmeier, Microencapsulation, Ullmann's Encyclopedia of Industrial Chemistry, 6th Edition 2001, Vol 21 Electronic Release, pages 733 to 749. The particularly suitable process can be chosen according to the desired wall thickness. The cited pages of the literature reference are incorporated herein by reference.

The production of the preferably used melamine formaldehyde microparticles comprises the use of melamine formaldehyde precondensates, which are water soluble and from which melamine formaldehyde resin microparticles are prepared from the aqueous phase. The production process has various advantages, for example inexpensive starting materials compared with other possible polymerization processes and the environmentally benign use of water as preferred solvent. When the enclosed or encapsulated biocidally active components are not readily soluble in water, the water used as solvent in the operation may alternatively be partly replaced by water-miscible organic solvents.

The production of the microparticles of the present invention preferably proceeds from an aqueous suspension of the biocidally active component or biocidally active component mixture using water as solvent. The microparticles of the present invention are preferably prepared by stirring in an acidic medium. The acidic medium is set using inorganic and/or organic acids such as for example hydrochloric acid, phosphoric acid and citric acid.

The microparticles can be prepared in the apparatuses customary for condensation polymerizations. Such apparatuses include stirred tanks, stirred tank batteries, autoclaves, tubular reactors, and kneaders. The reaction is carried out for example in stirred tanks equipped with an anchor, vane, impeller, dissolver or multi-stage pulsed counter-current stirrer. Apparatuses which permit direct isolation of the product after the polymerization are particularly suitable, examples being paddle dryers. The suspensions obtained can be dried directly in evaporators, for example belt dryers, paddle dryers, spray dryers or fluidized bed dryers. However, the bulk of the water can also be separated off by filtration or centrifugation.

The starting material used for the preferably used melamine formaldehyde resins is, firstly, available etherified melamine formaldehyde condensates with preferably minimal free formaldehyde, for example Quecodur DM 70 (available from THOR GmbH). On the other hand, the melamine formaldehyde resin can also be obtained by polycondensation of melamine and formaldehyde in the presence of the biocidally active component via techniques known to one skilled in the art, as by reaction between melamine and formaldehyde at a molar ratio of 1 to 6 parts of formaldehyde per one part of melamine.

The reaction is preferably carried out in aqueous solution. The concentration of the prepolymer in the aqueous solution can be varied within wide limits according to the wall thickness and the desired amount of biocidally active component in the final microparticles. It is most convenient to feed or form the prepolymer such that the prepolymer concentration is about 1% to about 70% by weight and preferably about 5% to about 50% by weight.

Aside from the aforementioned aminoplast resins, the microparticles of the present invention may comprise further materials which are common knowledge and customary depending on the intended use. These include appropriate binders and film-formers, such as polyacrylates, polystyrene acrylates or silicone resins, but also known auxiliary materials, such as pigments; fillers such as calcium carbonate, talcum, kaolins, silicates, fumed silica and/or zeolites; solvents; thickeners such as polysaccharides and/or cellulose ethers; defoamers; plasticizers; dispersants such as phosphates and/or acrylates; emulsifiers such as fatty alcohol ethoxylates, EO/PO block polymers and/or sulfonates; stabilizers such as UV stabilizers, coloring or discoloration-avoiding materials.

The polycondensation of the aminoplast resin can be carried out at any point within the range from about 20 to about 95° C., preferably between about 50 and 80° C.

The reaction will generally have ended within a few hours, although at high temperature the reaction can have ended within a few minutes.

As soon as the microparticles have formed, they can be stored and used as dispersions or recovered as dried particles by filtration. In either form, the particles are useful and effective in the controlled release of the biocidally active component.

The examples which follow elucidate both the process and the product of the present invention, but are not in any way intended to define or limit it.

The production examples elucidate the production of microparticles in which the biocidally active component is enclosed.

PRODUCTION EXAMPLE

The materials set out hereinbelow are used to prepare melamine formaldehyde microparticles enclosing the biocidally active component 2-n-octyl-4-isothiazolin-3-one.

| Materials used | Amounts [g] |
|---|---|
| Water | 430.00 |
| Polyacrylate (Coatex BR 3, from Dimed) | 1.50 |
| Gum arabic | 0.60 |

-continued

| Materials used | Amounts [g] |
|---|---|
| Silicone defoamer (Aspumit AP, Thor GmbH) | 0.30 |
| OIT | 60.00 |
| Hydrochloric acid 1% | 46.10 |
| Melamine formaldehyde resin (Quecodur DM 70, Thor GmbH) | 85.00 |
| | 623.50 |

To prepare the microparticles, the water was initially charged together with the melamine resin. Polyacrylate, gum arabic, silicone defoamer and the 2-n-octyl-4-isothiazolin-3-one were stirred into the initial charge. The mixture obtained was heated to 90° C. and hydrochloric acid was added dropwise during 1 h down to a pH of 4. Thereafter, the mixture was stirred at the same temperature for 2 h.

The mixture obtained contained the desired microparticles in which the biocidally active component is enclosed.

Inventive Example 1 and Comparative Example 1

The hereinbelow recited inventive and comparative examples demonstrate the effect of the enclosed OIT. Textiles finished with the microparticles of the present invention are compared with textiles finished with dispersed OIT.

To investigate the effect of the textile finished according to the present invention, various textile samples 40×40 cm in size were each impregnated in aqueous liquors with 30 g/l of an approximately 10% strength microparticle-containing composition or with a corresponding amount of a comparative product comprising conventionally dispersed OIT. 30 g/l Quecophob GAR (fluorocarbon resin; from THOR GmbH) was added as dressing aid. The textile samples were subsequently squeezed off via a pad-mangle, dried at 120° C. for one minute and cured at 150° C. for one minute. Before drying, the add-on was determined and used to compute the theoretical concentration of active component.

Samples were subsequently taken of the impregnated fabrics and analyzed by HPLC for their active component concentration. The results obtained are recited in Table 1.

TABLE 1

Results of inventive and comparative examples for loss of active component in drying of textiles.

| Material of textile sample | Theoretically determined value [ppm] | Enclosed OIT [ppm] | Dispersed OIT [ppm] |
|---|---|---|---|
| Polyester | 1400 | 1205 | 18 |
| Polyacrylonitrile | 2400 | 2032 | 44 |
| Cotton | 2500 | 2085 | 761 |

Inventive Example 2 and Comparative Example 2

Some of the textile samples finished according to the example were treated with water ("watered") for 24 hours and subsequently investigated for their active component content. Table 2 recites the active component concentrations before and after watering.

TABLE 2

Results of inventive and comparative examples for loss of active component in watering of textiles.

| Material of textile sample | Enclosed OIT, original [ppm] | Enclosed OIT, 24 h, watered [ppm] | Dispersed OIT, original [ppm] | Dispersed OIT, 24 h, watered [ppm] |
|---|---|---|---|---|
| Polyester | 1247 | 970 | 63 | 29 |
| Polyacrylonitrile | 1896 | 1842 | 76 | 36 |
| Cotton | 1870 | 1371 | 866 | 93 |

The values recited in Tables 1 and 2 clearly reveal the advantage of the inventive enclosure of the active component in microparticles. The textile finished with enclosed or encapsulated OIT has appreciably more detectable active component than the conventionally finished textile after thermal aftertreatment and watering. It is clear from the above experimental results that the enclosure of the biocidally active component reduces the loss of biocidally active component and emissions into the air/environment and also causes distinctly more active component to stay on the textiles.

Inventive Example 3 and Comparative Example 3

The polyester samples prepared according to Example 1 and the comparative example were tested for their fungus-inhibiting properties to German standard specification DIN 53931. The results are shown in Table 3.

TABLE 3

Results of inventive and comparative examples for fungus-inhibiting effect of enclosed OIT.

| Material | Enclosed OIT [area of growth] | Dispersed OIT [area of growth] |
|---|---|---|
| *Aspergillus niger*, Orig. | (0) | 4/5 |
| *Aspergillus niger*, 24 h, watered | (0) | 5/5 |
| *Chaetomium globosum*, Orig. | (0) | 4/4 |
| *Chaetomium globosum*, 24 h, watered | (0) | 5/4 |
| *Penicillium funiculosum*, Orig. | (0) | 4/3 |
| *Penicillium funiculosum*, 24 h, watered | (0) | 4/4 |

The assessment scheme of DIN 53931 (test for fungus-inhibiting effect) is shown hereinbelow.

| Area of growth | | |
|---|---|---|
| 00 | Whole plate free of growth | |
| 0 | Zone of inhibition around sample | mold-resistant |
| (0) | Fungus has grown as far as the sample | |
| 1 | Growth at edge of sample only | |
| 2 | Growth on sample from edge (less than 25%) | |
| 3 | Sample surface populated with individual colonies (25% to 75%) | not mold-resistant |
| 4 | Sample surface widely populated (75% or more, but not the entire area) | |
| 5 | Sample surface completely populated (100%) | |

The textile samples finished with enclosed OIT display excellent fungus-inhibiting properties. These fungus-inhibiting properties are still present even after the samples have been watered.

The invention claimed is:

1. A textile finished with a biocidally active component, characterized in that the biocidally active component is contained in the textile and comprises 2-n-octyl-4-isothiazolin-3-one and also, optionally, one or more other biocides, the biocidally active component being enclosed in microparticles composed of an aminoplast resin.

2. The textile according to claim 1 characterized in that the microparticles comprise 5% to 99.99% by weight of the aminoplast resin and 0.01% to 95% by weight of the biocidally active component, based on the overall weight of aminoplast resin and biocidally active component.

3. The textile according to claim 1 characterized in that the amount of biocidally active component is in the range from 0.0001% by weight to 0.5% by weight, based on the overall weight of the textile.

4. The textile according to claim 1 characterized in that the aminoplast resin is selected from the group of the melamine, urea, cyano and dicyandiamide formaldehyde resins or a mixture of two or more thereof.

5. The textile according to claim 1 characterized in that the aminoplast resin is a melamine formaldehyde resin.

6. The textile according to claim 1 characterized in that the aminoplast resin is a melamine urea formaldehyde resin or a melamine phenol formaldehyde resin.

7. The textile according to claim 1 characterized in that the aminoplast resin is formed from an NH-containing compound and acetaldehyde or glyoxal.

8. The textile according to claim 1 characterized in that the microparticles have a median diameter of about 0.5 to about 100 μm.

9. The textile according to claim 1 characterized in that the microparticles have a median diameter of about 1 to 10 μm.

10. The use of microparticles based on an aminoplast resin and containing the biocidally active component 2-n-octyl-4-isothiazolin-3-one and, optionally, one or more other biocides, for protecting textiles against attack by microorganisms.

* * * * *